United States Patent [19]

Sanford

[11] 4,031,686

[45] June 28, 1977

[54] COMBINATION WOOD AND METAL TRUSS STRUCTURE

[76] Inventor: Arthur Carol Sanford, 2308 Bay Drive, Pompano Beach, Fla. 33062

[22] Filed: Jan. 13, 1977

[21] Appl. No.: 759,072

[52] U.S. Cl. ..... 52/693

[51] Int. Cl.[2] ..... E04C 3/17; E04C 3/292

[58] Field of Search ..... 52/693, 640, 641, 639, 52/690, 730, 694; 85/13

[56] References Cited

UNITED STATES PATENTS

| | | | |
|---|---|---|---|
| 3,416,283 | 12/1968 | Sanford | 85/13 |
| 3,531,904 | 10/1970 | Sanford | 52/693 |

FOREIGN PATENTS OR APPLICATIONS

| | | | |
|---|---|---|---|
| 887,020 | 11/1943 | France | 52/639 |

*Primary Examiner*—John E. Murtagh

*Attorney, Agent, or Firm*—Hamilton, Renner & Kenner

[57] ABSTRACT

A truss having parallel wood chord members and diagonal web members therebetween connected to the chord members by toothed metal plates. The diagonal web members under compression are wood having their ends fitted into notches in the chord members and the web members under tension are preferably metal with their ends connected to one side of the chord members by toothed plates which overlie the notches. The toothed plates connecting the ends of the compression members to the chord members overlie the notches on the other side of the chord members.

8 Claims, 5 Drawing Figures

COMBINATION WOOD AND METAL TRUSS STRUCTURE

BACKGROUND OF THE INVENTION

The present invention relates to improvements over the truss construction shown in my prior U.S. Pat. No. 3,416,283, which disclosed parallel wood chord members and diagonal compression and tension web members of metal having perforated load transferring flanges at their ends connected to alternately opposite sides of the chord members by toothed plates abuttingly intermeshing the flange perforations and embedded in the chord members.

It has been determined that the use of diagonal metal webs for both the compression and tension members is not economically practicable because in order to resist buckling due to the compression stresses the compression web members must be much heavier and stronger than the tension web members.

Also, the fact that the metal web members are connected alternately to opposite sides of the chord members makes it difficult to apply the plates in assembling the trusses according to conventional methods by passing a horizontal pressure roll over the trusses because of the relatively large toothed plates on the underside of the truss not becoming fully embedded in the chord members.

Trusses have been proposed in which the compression members are vertical wood web members and the tension members are diagonal wood members, both the compression and tension web members being connected to the wood chord members by toothed metal plates. Such a construction requires additional compression members and exceptionally large wood tension members with correspondingly large toothed connector plates to transfer the loads, so that the construction becomes excessively expensive. Moreover, the clear space between the chord members for the passage of ductwork and the like is greatly reduced by the vertical compression members, especially in trusses of minimal depth, so as to require the cutting and weakening of diagonals to obtain the required space.

SUMMARY OF THE INVENTION

I have discovered that optimum results can be obtained by using a combination of diagonal wood compression web members with oppositely inclined diagonal metal tension web members, and the ends of the wood web members fitting into notches in the chord members, with the connector plates for the metal web members overlying the notches on one side of the chord members and the connector plates for the wood web members overlying the notches on the other side of the chord members.

It is an object of the present invention to provide an improved combination wood and metal truss structure utilizing toothed connector plates, which structure is economically practicable and of optimum load-supporting capacity.

Another object is to provide an improved combination wood and metal truss structure which has diagonal wood compression web members with their ends fitting in notches in the chords to take component horizontal stresses.

A further object is to provide an improved combination wood and metal truss structure in which the notches receiving the ends of the diagonal wood compression members are overlaid on one side by small, easily embedded connector plates for the compression web members and on the other side by the connector plates for the diagonal tension web members.

Another object is to provide an improved combination wood and metal truss structure having diagonal metal web tension members connected by toothed metal plates to one side of the wood chord members and diagonal wood web compression members connected by toothed metal plates to the other side of the wood chord members.

A still further object is to provide an improved combination wood and metal truss structure of optimum strength and minimal cost having maximum clearance space between chord members and web members for the passage of ductwork and the like.

These and other objects are accomplished by the improvements comprising the present invention, a preferred embodiment of which is shown by way of example in the accompanying drawings and described in detail in the following specification. Various modifications and changes in details of construction are comprehended within the scope of the appended claims.

DESCRIPTION OF A PREFERRED EMBODIMENT

Figure 1:
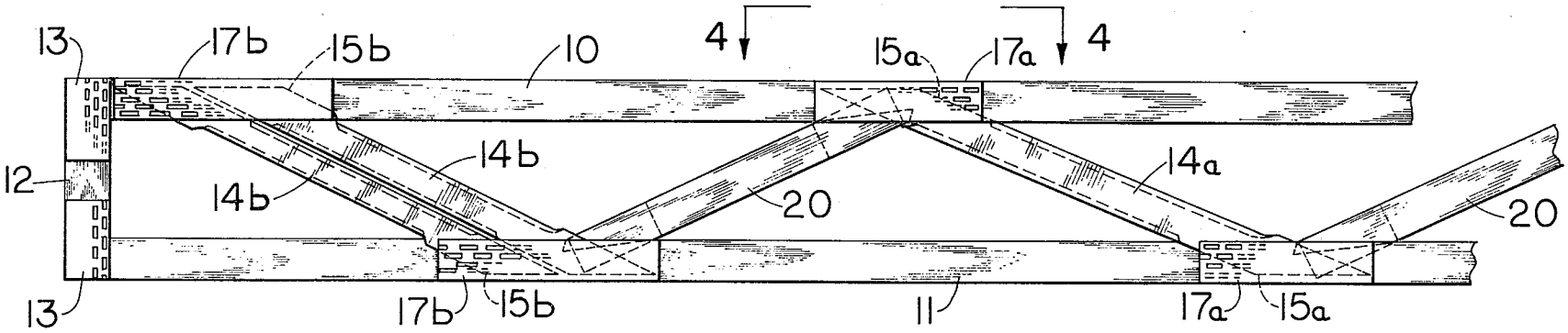
FIG. 1 is a partial side elevation of a combination wood and metal truss embodying the invention.
Figure 2:
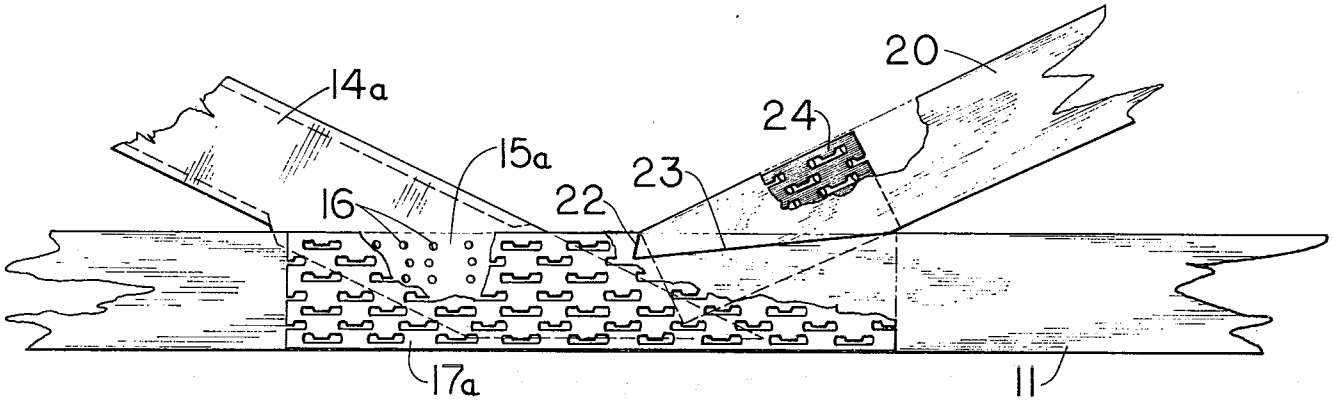
FIG. 2 is an enlarged elevation, partly broken away, of one of the joints between the diagonal wood and metal web members and the lower chord of the truss.
Figure 3:
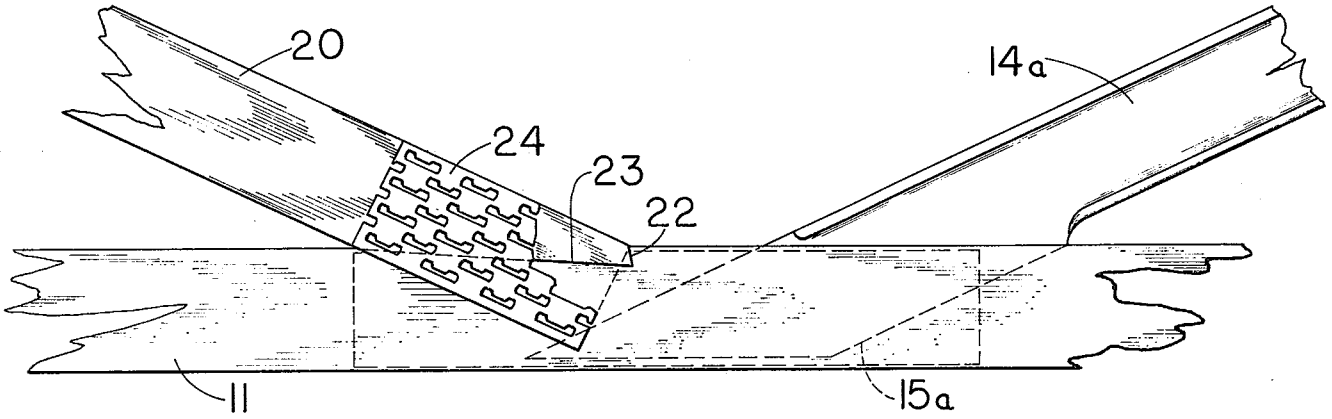
FIG. 3 is a similar view of the same joint taken from the opposite side of the truss.
Figure 5:
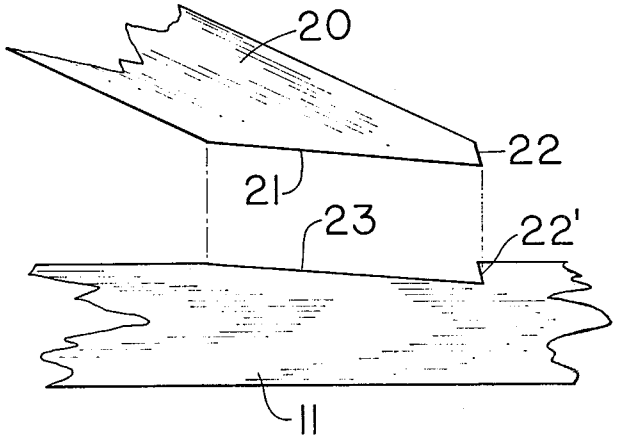
FIG. 5 is an exploded view similar to FIG. 3, with the connector plates removed.
Figure 4:
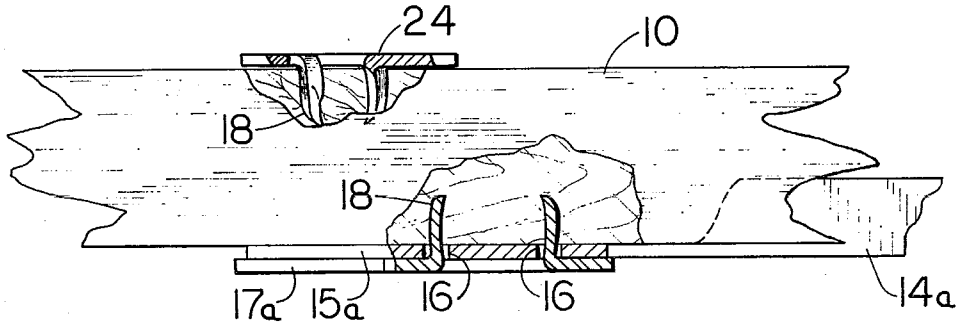
FIG. 4 is an enlarged plan elevation, partly broken away, as on line 4—4 of FIG. 1.

The Warren type truss shown in FIG. 1 may be used as a floor or ceiling truss in which the top or bottom chord is supported at the ends. The top and bottom chords 10 and 11 are preferably standard wood 2 × 4's, and a vertical wood 2 × 4 compression member 12 between the chords at each end may be connected to the chords by toothed plates 13 on opposite sides of the chords. The construction at the opposite end of the truss (not shown) is identical.

The chords 10 and 11 have their wider faces opposite each other so that their narrower faces are at opposite sides of the truss, as are the narrower faces of the end compression members 12. The toothed plates 13 preferably have staggered rows of struck-out teeth, and the design and pattern of the teeth may be according to the teeth shown in my prior patent, U.S. Pat. No. 3,416,283, although various other designs of toothed plates having different tooth configurations may be used to accomplish the purposes of this invention.

The truss shown in FIG. 1 is a truss of relatively shallow depth but various depths and spans of trusses may be used. The inclined web members **14*a* and 14*b* are preferably metal channels with flat load transfer flanges 15*a* and 15*b*, respectively, at their ends. The truss shown is designed so as to subject the web members 14*a* and 14*b* to tension stresses, and since the stresses are greatest at the ends of the truss, two side-by-side channels 14*b* may be required at those locations. Preferably, the flanges 15*a* and 15*b* are extensions of the bases of their respective channels, but the web members may be tubular or have other cross sections with end flanges 15***a* and 15*b* formed thereon.

The load transfer flanges 15*a* and 15*b* each have a plurality of perforations 16 which may be circular, and are arranged in a pattern so as to intermesh with at least a portion of the teeth 18 of toothed plates 17*a* and 17*b* which connect the web members 14*a* and 14*b* to the chord members 10 and 11 by embedding the teeth 18 into the sides of the wood chord members. As stated in U.S. Pat. No. 3,416,283, the exact configuration of the perforations 16 is not critical so long as they intermesh and engage with the teeth 18 so as to maintain the web member fixed with respect to the chord member to which it is secured when the truss is under load.

The construction thus far described per se constitutes no part of the present invention.

As shown in the drawings, the areas of the connector plates 17*a* and 17*b* extend substantially beyond the areas of the perforated load transfer flanges connected thereto. This gives the plates greater strength in shear and provides increased holding power of the teeth in the wood by providing an increased number of teeth to transfer the loads. It also armors the wood chords against crushing at those locations. The load transfer flanges 15*a* and 15*b* and the connector plates 17*a* and 17*b* intermeshing therewith are all disposed on one side of the chords 10 and 11.

According to the present invention, the web members subjected to compression are wood 2 × 4's indicated at 20 alternating with and oppositely inclined to the tension members 14*a* and 14*b* and preferably at the same angle to the chords 10 and 11. These web members 20 are disposed so that their narrower faces are in the planes of the sides of the chords 10 and 11. The ends of web members 20 are first cut off so as to accurately control their lengths. They are then accurately machine beveled as indicated at 21 leaving preferably an acute angled end portion 22. Oppositely disposed triangular notches 23 accurately conforming to the acute angled and beveled ends are machine cut in the inner opposing faces of the chords 10 and 11. It is important to cut the ends of the web members 20 and the notches 23 so that an exact tightly fitting joint is obtained between the web members and notches for efficiently resisting compression stresses. The deep end 22' of the notch provides an undercut to prevent popping out of the web members during assembly. The notches are located at intervals longitudinally of the chords so that they are overlaid on one side by the plates 17*a* and 17*b*. On the other side the notches are overlaid by relatively small toothed connector plates 24 which connect the web members 20 to the chords 10 and 11 on the sides opposite to the connector plates 15*a*. Thus, the web members 20 are securely held in the notches against lateral movement in either direction by the toothed connector plates 17*a* and 24. The plates 24 can be substantially smaller in area than the connector plates 17*a* because the compression stresses are transmitted directly from the notches 23 to the web members 20, and the abutment between the ends 22 and the deeper ends 22' of the notches takes the horizontal component of compression stress directly.

In assembling a truss on a jig bed, the compression web members 20 with the plates 24 tacked thereon are positioned with their beveled ends fitting in the notches 23 in the chords 10 and 11 and the extending portions of the plates 24 under the bottom sides of the chords and underlying the notches therein. The diagonal tension web members with the toothed plates 17*a* and 17*b* attached are then placed on the upper side of the truss with the plates overlying the notches 23. The parts are clamped in position on the bed and the lead ends of the connector plates are tapped with a hammer to set the teeth in the wood. Preferably, a traveling or gantry roller press is then passed over the jig bed to partially embed the exposed teeth of the plates 24 in the bottom faces of the truss chords and the teeth of the plates 17*a* and 17*b* in the top faces of the truss chords. The assembled truss may then be slid longitudinally from the jig bed and through a pair of pinch rolls to complete full embedment of the toothed plates in the wood members.

Obviously, trusses of varying depths and spans can be laid out, clamped in position and connected by the roller press.

The combination wood and metal truss structure comprising the invention is economically practicable and of optimum load capacity while providing diagonal wood compression web members with their ends fitting notches in the chord members and toothed connector plates for the diagonal compression and tension members overlying the notches on both sides of the truss. The truss structure facilitates assembly on a horizontal jig bed by passing a roller press thereover, and maximum clearance for passage of ductwork and the like is provided between the chord members of the finished truss.

I claim:

1. A combination wood and metal truss structure comprising wood chord members and a series of diagonal compression and tension web members therebetween, said compression members being wood members oppositely inclined to said tension members, toothed metal plates connecting the ends of all said web members to the sides of said chord members, the opposed inner surfaces of said chord members having notches abuttingly receiving the ends of said compression web members, the connector plates for the compression web members overlying said notches on one side of said chord members, and the connector plates for the tension web members overlying said notches on the other side of said chord members, whereby movement of the compression web members laterally of said chord members is prevented.

2. A combination wood and metal truss structure as defined in claim 1, wherein the wood compression members and the notches are coextensive in width with said wood chord members.

3. A combination wood and metal truss structure as defined in claim 1, wherein the diagonal compression and tension web members alternate in a zig-zag arrangement.

4. A combination wood and metal truss structure as defined in claim 1, in which the tension members are metal and have load transfer flanges at their ends in abutment with said other side of said chord members, said flanges having a plurality of apertures therein and the toothed metal plates connecting said ends to said chord members overlie said transfer flanges and have their teeth extending through said apertures into the chords.

5. A combination wood and metal truss structure as defined in claim 4, wherein the wood compression members and the notches are coextensive in width with said wood chord members.

6. A combination wood and metal truss structure as defined in claim 4, wherein the diagonal compression and tension web members alternate in a zig-zag arrangement.

7. A combination wood and metal truss structure as defined in claim 4, wherein the toothed metal plates overlying the transfer flanges extend longitudinally of the chord members beyond said transfer flanges, said extended portions overlying said notches.

8. A combination wood and metal truss structure as defined in claim 6, wherein the toothed metal plates overlying the transfer flanges extend longitudinally of the chord members beyond said transfer flanges, said extended portions overlying said notches.

* * * * *